US007048628B2

(12) United States Patent
Schneider

(10) Patent No.: US 7,048,628 B2
(45) **Date of Patent: *May 23, 2006**

(54) NETWORKED GAMING DEVICES USING BONUS TOKEN TO EFFECTUATE BONUS AWARDS

(75) Inventor: Richard J. Schneider, Las Vegas, NV (US)

(73) Assignee: Acres Gaming Incorporated, Las Vegas, NV (US)

( * ) Notice: Subject to any disclaimer, the term of this patent is extended or adjusted under 35 U.S.C. 154(b) by 223 days.

This patent is subject to a terminal disclaimer.

(21) Appl. No.: 10/087,896

(22) Filed: Oct. 18, 2001

(65) Prior Publication Data

US 2003/0078088 A1 Apr. 24, 2003

(51) Int. Cl.
*A63F 9/24* (2006.01)

(52) U.S. Cl. ..... 463/16; 463/20; 463/25; 463/42

(58) Field of Classification Search ..... 463/16–22, 463/26, 40–42
See application file for complete search history.

(56) References Cited

U.S. PATENT DOCUMENTS

| | | | | | |
|---|---|---|---|---|---|
| 5,217,224 | A | | 6/1993 | Sincock | |
| 5,645,486 | A | | 7/1997 | Nagao | |
| 5,655,961 | A | * | 8/1997 | Acres et al. | 463/27 |
| 5,707,285 | A | | 1/1998 | Place et al. | |
| 5,833,540 | A | | 11/1998 | Miodunski et al. | |
| 5,876,284 | A | * | 3/1999 | Acres et al. | 463/25 |
| 6,012,982 | A | | 1/2000 | Piechowiak et al. | |
| 6,146,270 | A | | 11/2000 | Huard et al. | |
| 6,146,273 | A | * | 11/2000 | Olsen | 463/27 |
| 6,217,448 | B1 | * | 4/2001 | Olsen | 463/25 |
| 6,244,958 | B1 | | 6/2001 | Acres | 463/26 |
| 6,319,125 | B1 | | 11/2001 | Acres | 463/25 |
| 6,358,149 | B1 | * | 3/2002 | Schneider et al. | 463/27 |
| 6,364,768 | B1 | * | 4/2002 | Acres et al. | 463/25 |
| 6,375,567 | B1 | * | 4/2002 | Acres | |
| 6,375,569 | B1 | * | 4/2002 | Acres | 463/27 |
| 6,565,434 | B1 | * | 5/2003 | Acres | 463/25 |
| 6,575,832 | B1 | | 6/2003 | Manfredi et al. | 463/25 |

FOREIGN PATENT DOCUMENTS

| | | |
|---|---|---|
| WO | WO 00/17825 | 3/2000 |
| WO | WO 01/15790 | 3/2001 |

* cited by examiner

*Primary Examiner*—Xuan M. Thai
*Assistant Examiner*—Alex F. R. P. Rada, II
(74) *Attorney, Agent, or Firm*—Marger Johnson & McCollom, PC

(57) ABSTRACT

A plurality of gaming machines, such as slot machines or the like, are networked together in communication with a bonus server. The bonus server identifies each machine on the network and transmits a bonus token across the network to a machine control interface within a selected one of the machines. The bonus token is preferably a message packet containing the unique address of the gaming machine selected as well as various parameters which govern aspects of a bonus session initiated at the machine. Receipt of the bonus token signal at the machine causes additional lighting and sound effects beyond that enabled by the normal operation of the game. The bonus token also enables additional bonuses within the game that are awarded to a player of the selected machine. At the end of a bonus period, the bonus token is returned to the bonus server, processed to introduce new parameters, and then transmitted to a second one of the plurality of gaming machines at the proper time. The bonus token is passed in this way, periodically, from machine to machine to enhance the gaming experience of the lucky player of the selected gaming machine.

10 Claims, 4 Drawing Sheets

NETWORKED GAMING DEVICES USING BONUS TOKEN TO EFFECTUATE BONUS AWARDS

BACKGROUND OF THE INVENTION

This invention relates generally to electronic gaming machines interconnected by a computer network and more particularly to a method and apparatus for implementing a bonus across a gaming machine network.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Under a normal mode of operation, some combinations of symbols do not pay any jackpot. Others pay varying amounts according to predetermined combinations that appear in a pay table displayed on the machine and stored in the gaming machine's programmable read-on memory (PROM).

More recently, multiple gaming machines have been linked together into groups of machines that share the same gaming features and bonus pool. A simple example of such a system is progressive video poker in which players can win a collective pool of money from any one of a plurality of gaming machines grouped together on the casino floor. More complex examples for bonusing are implemented using bonus servers over a network, such us disclosed in co-owned U.S. Pat. No. 6,319,125 (the '125 patent), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

Gaming machine players often harbor a belief in streaks and tend to play only those games that they think are "hot" and ready to pay a big jackpot. This is even truer with linked machines. If a prospective player in a casino passes by a bank of gaming machines in which very little is happening, the player's impression might be that the machines in the bank are "cold" and the player will consequently refuse to stop and play them. If, however, the machines give the impression that they could win substantial bonus awards at any time, then the player would be more likely to sit and play.

Accordingly, in order to increase the excitement of playing gaming devices, it is desirable to provide a device in which a bonus event for a gaming machine or group of gaming machines is possible at any time.

SUMMARY OF THE INVENTION

The invention comprises a method for awarding bonuses over a gaming network having a plurality of gaming machines interconnected by a network. Play is allowed to occur on a plurality of gaming machines. A bonus token signal is then sent to a first selected subset (which can include only one) of the plurality of gaming machines responsive to a bonus pool threshold crossing. A bonus period is initiated at only that first selected subset of the plurality of gaming machines responsive to the bonus token signal. The first selected gaming machine operates in a bonus mode until the bonus period expires. The bonus token signal is then passed back to the bonus server and thence to a second selected subset of the plurality of gaming machines upon a further bonus pool threshold crossing.

The system for implementing the method includes a plurality of gaming machines, each of said machines having a normal operation mode and a bonus mode. A bonus server is linked to the plurality of gaming machines over a network. The bonus server includes selection means for identifying at least a selected one of the plurality of gaming machines and signal generation means for generating a bonus token signal. Signal transmission means are included for sending the bonus token signal to at least the selected one of the plurality of gaming machines responsive to the selection means. In operation, the selected one of the plurality of gaming machines switches from the normal operation mode to the bonus mode responsive to receipt of the bonus token signal.

The foregoing and other objects, features and advantages of the invention will become more readily apparent from the following detailed description of a preferred embodiment of the invention that proceeds with reference to the accompanying drawings.

DETAILED DESCRIPTION

Figure 1:
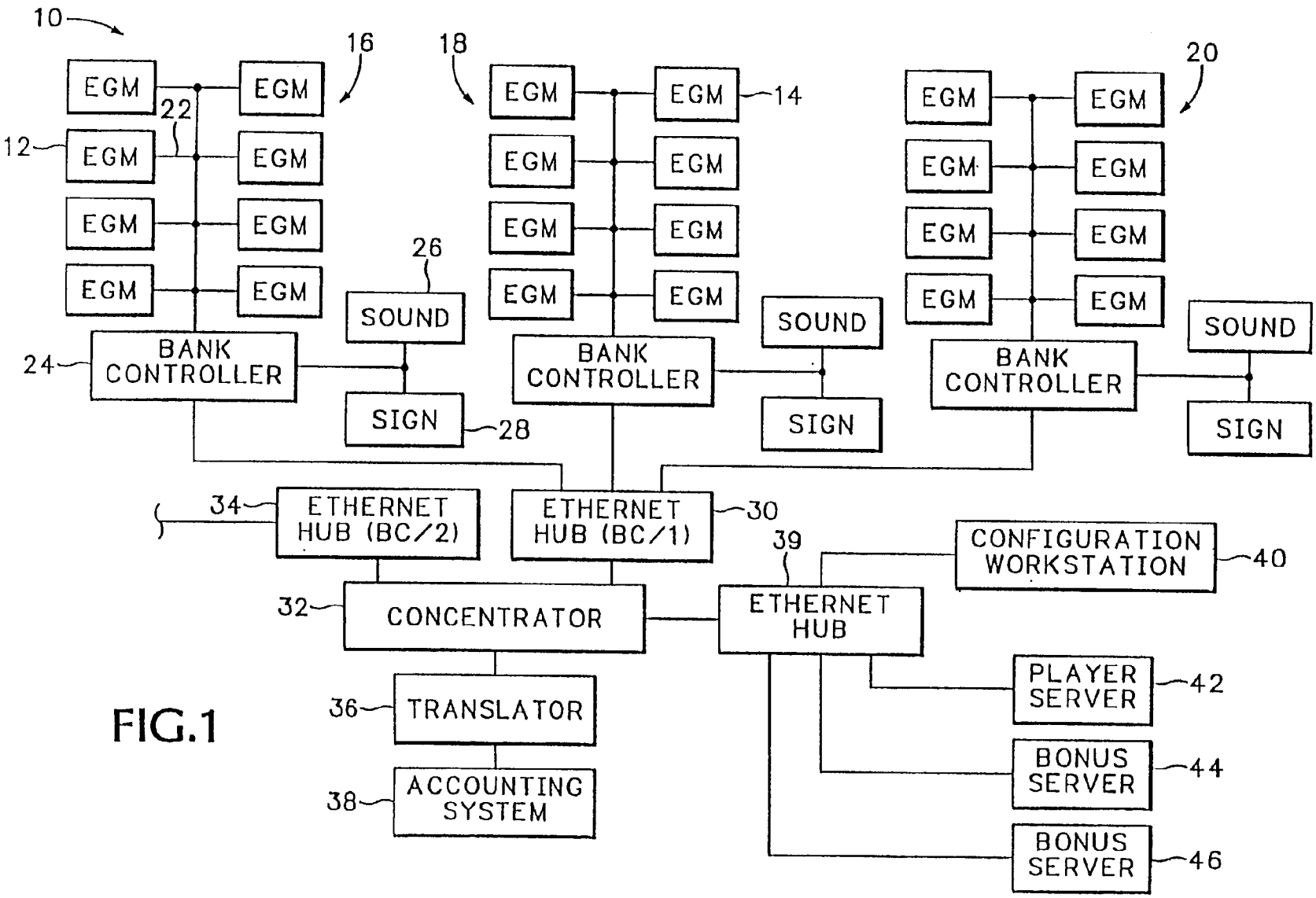
FIG. 1 is a schematic diagram showing a plurality of electronic gaming machines interconnected by a computer network to a host computer in accordance with the present invention.

Turning now to FIG. 1, indicated generally at 10 is a schematic diagram illustrating a plurality of electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24.

In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. Accounting system 38 keeps track of individual player accounts in cooperation with card reader 60 (FIG. 2) located at each of the gaming machines. In the present embodiment of the invention, translator 36 comprises an Intel Pentium 233 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses That can be implemented on the network are disclosed in co-owned U.S. Pat. No. 6,319,125 (the '125 patent), which is incorporated herein by reference for all purposes. This co-pending application also describes in more detail features of the network, like that shown in FIG. 1, that may be used to implement the present invention. The '822 patent also discloses bonuses that can be implemented by bonus servers 44, 46 and a network that could be used to implement the present invention.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-pending application Ser. No. 08/343,411, filed Apr. 15, 1997 and assigned to the Assignee of the present application (the '411 application), which is incorporated herein by reference for all purposes. This co-pending application also describes in more detail features of the network, like that shown in FIG. 1, that may be used to implement the present invention. The '961 patent also discloses bonuses that can be implemented by bonus servers 44, 46 and a network that could be used to implement the present invention.

As used herein, the term bonus amount indicates any one award made to a player on a gaming machine resulting from a jackpot won according to the pay table on one of the EGMs and any additional amount indicated by a supplemental bonusing system. The '125 patent and '961 patent include many examples of bonusing systems that can be implemented to supplement the original pay table jackpot award.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. When the slot machines are operating under a normal mode, some combinations of symbols do not pay any jackpot. Others pay varying amounts according to predetermined combinations that appear in a pay table displayed on the machine and stored in the gaming machine's programmable read-on memory (PROM). In the present invention, the gaming machines on the network are also programmed to include a bonus mode in which additional features are enabled responsive to communications from the bonus servers as described in more detail described further below.

Figure 2:
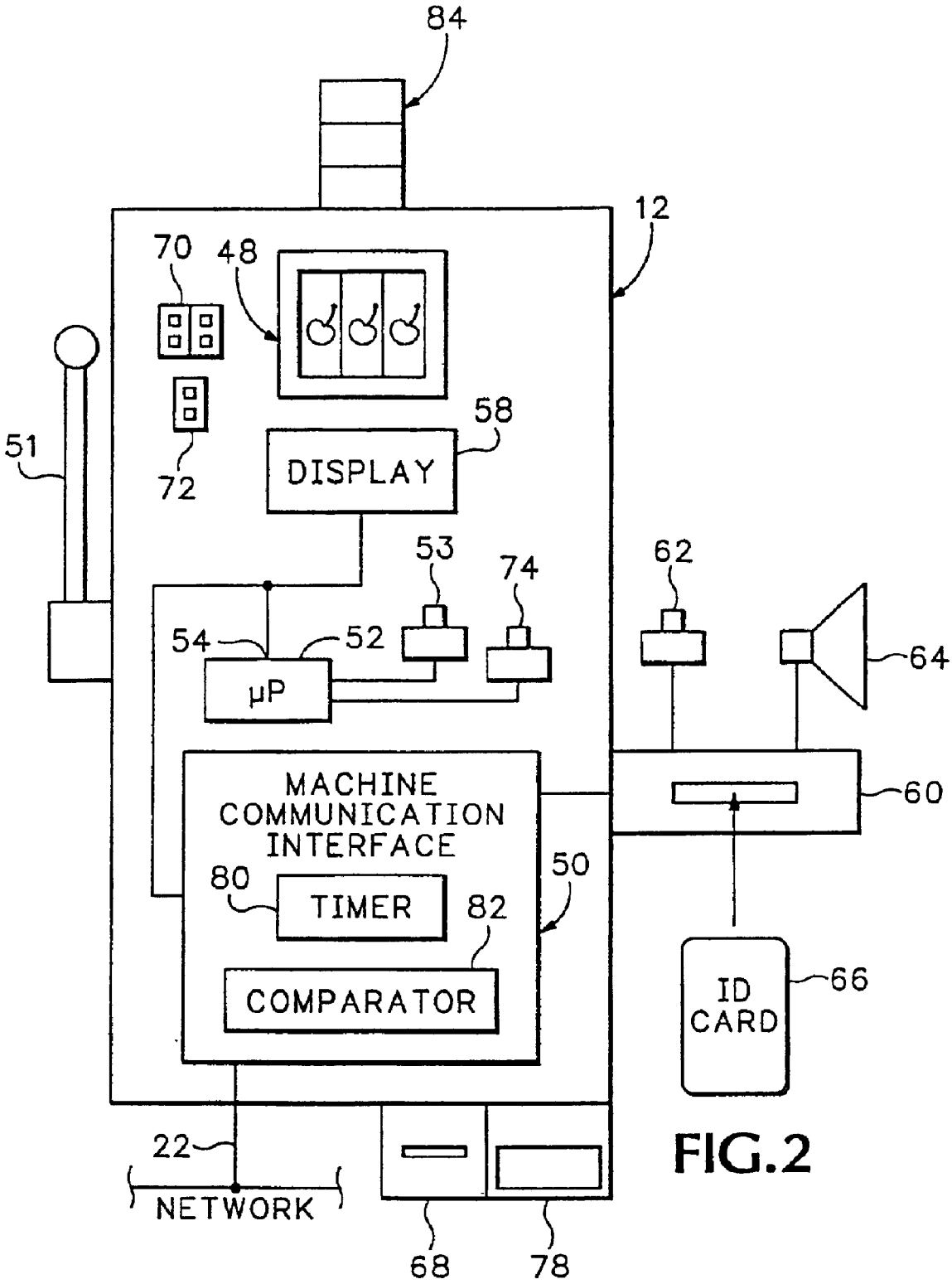
FIG. 2 is a schematic diagram of a slot machine and associated hardware implemented in accordance with the present invention.

FIG. 2 is a highly schematic representation of an electronic slot machine—typical of each of the machines in the network—that incorporates network communications hardware as described hereinafter. This hardware is described in the '961 patent and is referred to therein as a data communications node. Preferably the network communications hardware is like that disclosed in the '411 application, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected. In a preferred embodiment, MCI 50 includes a timer 80 and a comparator 82 whose purpose will be explained more fully below.

FIG. 2 is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected. In a preferred embodiment, MCI 50 includes a timer 80 and a comparator 82 whose purpose will be explained more fully below.

Included in EGM 12 are three reels, indicated generally at 48. Each reel includes a plurality of different symbols thereon. The reels spin in response to a pull on handle 51 or actuation of a spin button 53 after a wager is made.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Machine 12 further includes a indicator light, such as hat light 84 located atop the machine, for indicating to players which of the machines has received a bonus token and is currently operating in bonus mode as later described herein. In a preferred embodiment, hat light 84 is comprised of three independent light portions—top, middle and bottom—each of which indicate whether the machine is currently in a bonus mode of a particular type.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed, a single credit transfers to the coin-in meter up to a maximum bet that can be placed on a single play of the machine. In addition, a maximum-bet button (also not shown) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account or record that is stored in a database of other player accounts stored on accounting system 38 (in FIG. 1). Prior to playing one of the EGMs in FIG. 1, the player inserts card 66 into reader 60 thus permitting accounting system 38 to tack player activity, such as amounts wagered and won and rate of play.

To induce the player to use the card, the casino awards to each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

According to a preferred method for operating the gaming machines over a network, a single selected machine (or selected subset) out of a group of machines would be in a bonus mode funded by play at the machines. The bonus mode is enabled by passing what is referred to herein as a "bonus token" between gaming machines. As will be more fully explained below, the bonus token resides in any one of the plurality of eligible gaming machines for a bonus period during which the selected gaming machine operates in an enhanced or bonus mode. At the expiration of that bonus period, the bonus token is passed back to the bonus server where it is reconfigured as required and transferred to a second selected gaming machine or subset of the gaming machines to start the cycle anew.

Figure 3:
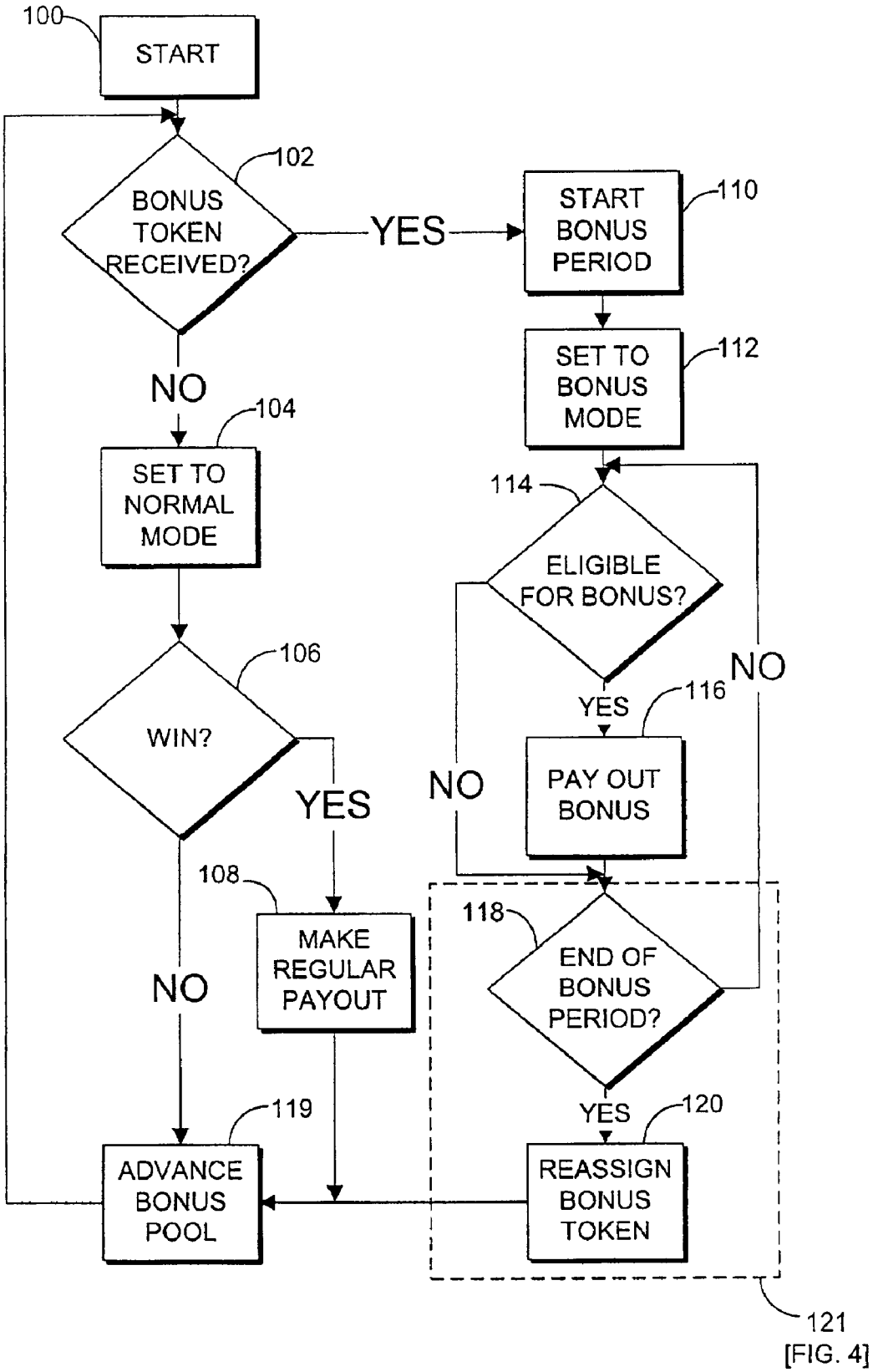
FIG. 3 is a flow diagram illustrating the operation of the gaming machine of FIG. 2 during the distribution of the bonus token across the network of FIG. 1 in accordance with a feature of the invention.

FIG. 3 illustrates the preferred method for implementing the invention over a gaming network. Play is allowed to occur on the plurality of gaming machines in step 100, such as on machine 12. In a preferred embodiment, a bonus pool is accumulated from a selected percentage of the bets placed on the gaming machine during play. An upper threshold value is selected—as by the casino operator at the configuration workstation 40 (FIG. 1), calculated based on the number of machines played, or by other means. When the accumulated bonus pool crosses the upper threshold value by meeting or exceeding that value, a bonus server such as server 44 (FIG. 1) generates a bonus token consisting of a message packet that includes a unique address (such as an IP address) which specifies a target machine. The unique address or subset of addresses is generated by selection means within the server that operates according to methods described with respect to step 120 explained below. For instance, the gaming machine ID number can be determined based on any one of the following: simple random, random with no back-to-back, random without replacement, deterministic, or weighted random. Other method for determining the gaming machine ID number can be envisioned and are not intended to be limited to the methods listed above.

The token would also include various parameters relating to the bonus session. These might include, but are not limited to, the session length (step 118), a pay multiplier value or other type of bonus available (step 116), special player messaging instructions to be displayed on display 58 (FIG. 2), etc. Each of these parameters are generated by program means operating according to bonus game rules, examples of which are disclosed below.

Once play begins, the MCI 50 on each gaming machine is queried to determine whether a bonus token has been received (step 102). In one method of operation, there can be point-to-point communication between the bonus server and the selected machine. Preferably, however, the bonus token is broadcast to all gaming machines on the network. As stated above, a trigger for the bonus token selection and broadcast can be when the accumulated bonus pool crosses the upper threshold. The comparator 82 of each machine's MCI 50 then compares the gaming machine ID number embedded within the gaming machine to that listed in the bonus token message packet.

If the ID number of the bonus token does not match the ID number of the gaming machine, then the MCI 50 sets or maintains the gaming machine in normal mode (step 104) in which play is processed normally according to default rules established for the particular gaming machine. Under a normal mode of operation, for instance, some combinations of symbols from reels 48 (FIG. 2) do not pay any jackpot. Others pay varying amounts according to predetermined combinations that appear in a pay table displayed on the machine and stored in the gaming machine's programmable read-on memory (PROM). During normal play, a win (step 106) is determined by comparing the reel combination resulting from play with the pay table. Payouts are then made normally (step 108) according to the amounts specified in the pay table. The bonus pool is funded by coin-in play in block 119 and the process then returns back to the step of querying the MCI 50 (block 102) to determine whether the bonus token with the applicable gaming machine ID number has been received.

If the ID number of the bonus token matches the ID number of the gaming machine, then the MCI 50 activates countdown timer 80 according to the bonus period length, if any, specified in the bonus token message packet (step 110) and places the machine in a bonus mode (112), which activates visual and audio cues. One example of this is to activate hat light 84 to indicate that the machine is in bonus mode. The gaming machine selected in this fashion is called the selected machine.

A second level query (step 114) is made to determine whether a player on a selected machine would be eligible for bonuses payable during the bonus session. Examples of eligibility criteria, such as payment of a MAX bet, are listed below. If the player is deemed eligible, then the MCI authorizes payment (step 116) of the bonus according to the bonus mode rules stored in gaming machine memory.

In bonus mode, the MCI of the selected gaming machine enables additional gaming features of the selected gaming machine. These additional features include bonus payouts above and beyond those jackpot awards that would occur during play in normal mode. Examples of such bonuses, such as payout multipliers, are specified below.

Once the bonus has been paid to eligible players, play proceeds to a determination of whether the bonus session has expired (step 118). During operation in bonus mode in one embodiment of the invention, a timer 80 (FIG. 2) is started upon receipt of the bonus token at the gaming machine having the correct ID number. The length of time at which the timer is set (e.g. 10 seconds) is either programmed in memory within the gaming machine or transferred as data from the bonus server to the gaming machine within the bonus token. The timer then counts down to time t=0 at which time the bonus period expires and the bonus token is transmitted back to the bonus server where it is reassigned in step 120 to a second selected gaming machine.

Figure 4:
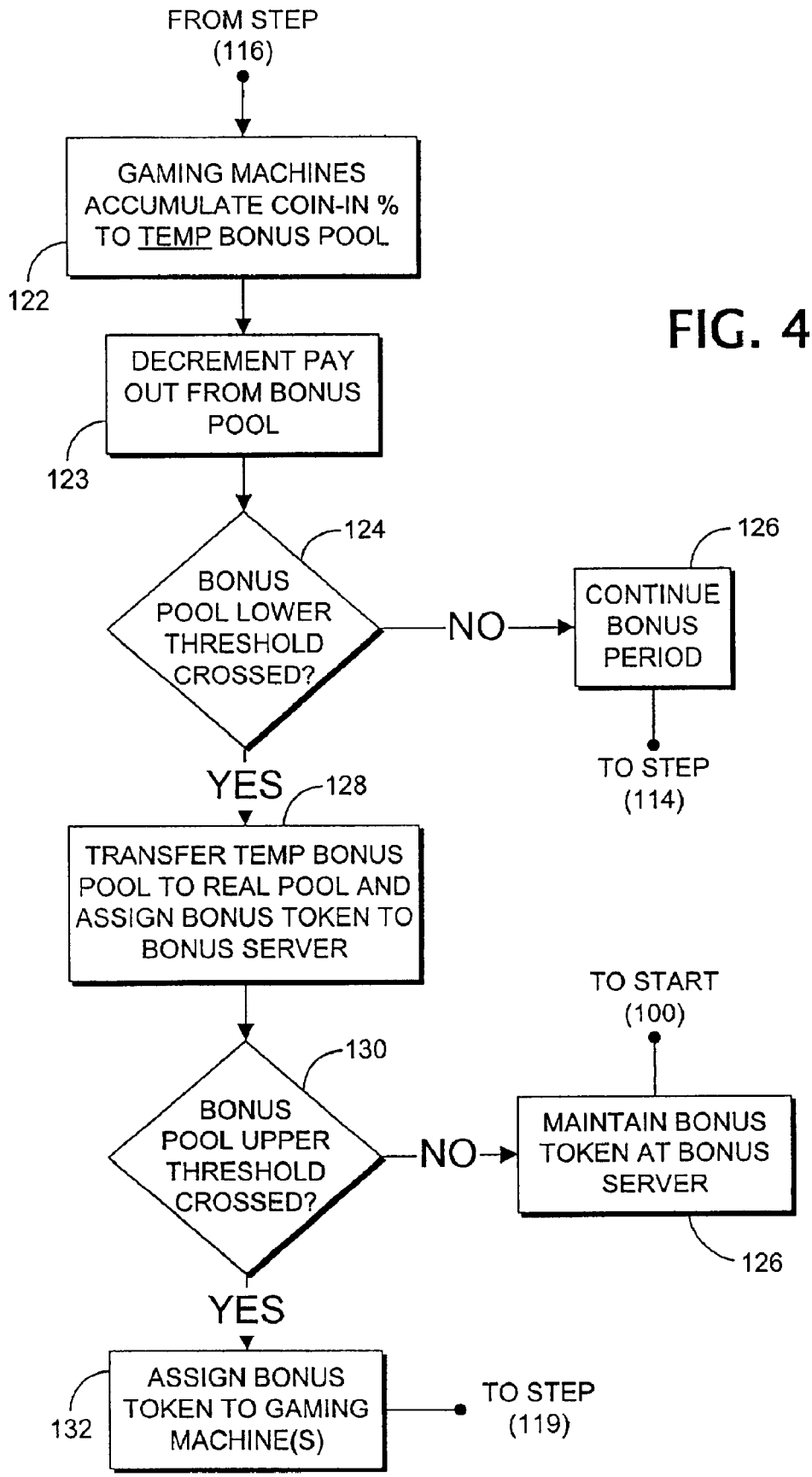
FIG. 4 is a flow diagram illustrating further operation of the gaming machine of FIG. 2 during distribution of the bonus token across the network of FIG. 1 in accordance with a feature of the invention.

FIG. 4 illustrates another embodiment of the operation of the invention where the bonus period lasts until the bonus pool drops below a lower threshold such as zero or some other amount lower than the upper threshold. The embodiment is intended to substitute for the steps found in dashed process block 121 in FIG. 3. From step 116, play proceeds to block 122 where coin-in funding of the bonus pool is diverted to a temporary bonus pool during the bonus period. This feature is desirable to prevent the situation where the bonus pool would continue to be funded from coin-in play and thus never drop below the lower threshold so that the bonus period lasts indefinitely. Thought this circumstance would be desirable from the point of view of the player whose machine currently has the bonus token and is operating bonus mode, it would be unacceptable from the casino's point of view.

Bonus award payouts are decremented from the bonus pool to yield an adjusted bonus pool amount in block 123. A query in block 124 determines whether the bonus pool lower threshold has been crossed. If the lower threshold has not been crossed, then play proceeds to block 126 and thence to block 114 where bonus mode play continues on the first subset of machines. If decrementing the bonus award payout from the bonus pool does in fact result in the adjusted bonus pool crossing the lower threshold, then play proceeds to block 128. In block 128, the bonus token from the first subset of machines is transferred from the machines back to the bonus server and the bonus period ended at those machines contemporaneously with bonus token removal. Upon removal, the amount accumulated in the temporary bonus pool—as by coin-in funding by all machines, only those not in the bonus period, or some subset thereof—is transferred to the regular or "real" bonus pool. A query in block 130 determines whether the newly funded onus pool crosses the upper threshold. If so, then play proceeds to block 132 and the bonus tokens are assigned to a second subset of machines determined by the bonus server and a new bonus period commences. If the newly funded bonus pool is less than the upper threshold, then the bonus token is maintained at the bonus server (block 126) and play proceeds to start block 100.

Further details about the methods for carrying out a preferred embodiment of the invention are detailed below:

Set Bonus Mode (step 112)

Ideally, the bonus period would be accompanied by animations, flashing lights, sounds, etc. on the bonus machine to attract attention to the bonus event. This would be particularly appealing if relatively small groups of machines were participating in the promotion. Imagine a carousel of 10 to 20 games, such as a bank of machines 16 (FIG. 1), with the bonus feature lasting 5 seconds on each machine. One could watch the feature jump from game to game. With the right visual and sound cues, this would make for a much more enjoyable experience. From a marketing point of view, the concept also has some advantages, in that, one could advertise that, "there is always one machine that is a winner, if you play long enough it will happen on your machine" or "the winning never stops", etc.

Eligible for Bonus? (step 114)

Besides no play on the game, there could be any number of criteria used to determine if a game is eligible for the bonus. Examples are listed below:

1. Gaming machine ID matches ID listed within bonus token.
2. Player tracking card 66 (FIG. 2) must be inserted in gaming machine 12.
3. Maximum coin bet must be played.
4. Specified play rate in coins/minute.
5. A particular reel sequence is obtained.
6. The "rating" of the player currently at the machine (e.g. whether he or she is a valued patron of the casino).

If the selected gaming machine is deemed eligible, then play proceeds to the next step in which the bonus is paid to the player (step 116). If the gaming machine is not eligible, then step 116 is skipped and a determination is made whether the bonus period has expired (step 118). In either case, however, pay table jackpots would be paid out normally given the proper reel sequence.

Pay Out Bonus (step 116)

Once eligibility of the machine is determined, bonuses can be paid out. The basic premise is that a single machine (or subset) out of group of machines would be selected for a bonus. The bonus could take many different forms, such as:

1. Pay table wins for one or more spins are multiplied by a bonus multiplier.
2. Large bonus prize awarded if any one or more spins within the bonus period yields a specified combination.
3. Player tracking points for one or more spins are accumulated at some multiplied rate (e.g. 10× or some other multiplier).
4. A randomly determined prize is instantly awarded.
5. A free-for-all session in which a player's bet is refunded on any losing spin.
6. A free game session in which x number of free spins or non-redeemable credits that must be wagered on the gaming machine are awarded.
7. Pay table changed to a bonus pay table with more frequent and/or higher pays. This can also include special pays for "almost" winners, e.g. "BAR-BAR-Blank" on a slot machine or a video poker hand that is one card away from a royal flush.

End of Bonus Period? (Step 118)

In the preferred embodiment of the invention, duration of the bonus session at the selected machine is regulated by setting a bonus spin time using timer 80 (FIG. 2). When timer 80 reaches t=0, then the bonus session is ended and the bonus token is returned to the bonus server across the network where it is processed and reassigned as discussed below with reference to step 120.

In another embodiment of the invention, the duration of the bonus session at the selection machine or group is regulated by finding within the bonus pool—that is, whether the bonus pool amount from which the bonus awards are paid has dropped below a predetermined lower threshold value. If so, then the bonus period ends.

A combination of these principals can also apply. That is, a bonus token can be passed concurrently from machine to machine during the bonus period when the bonus pool is still above the lower threshold. When the bonus pool drops below the lower threshold, however, the bonus token is passed back to the bonus server. During a bonus period, therefore, there is always at least one machine that is operating within bonus mode during the bonus period.

The purpose of the bonus token is to ensure that only one (or some other specified subset) of games are in a bonus mode at any one time. If the timer method is used, it is possible that a game could get "stuck" in a bonus session. The bonus server would then generate another token and send it to a machine. This would result in too many bonus tokens moving around the system and interfere with the carefully calculated payback percentage that the casino sets for the gaming machines.

In an alternate embodiment of the invention, the bonus server would wait for the acknowledgement from the game that the bonus session was concluded prior to creating a new bonus token. However, as a practical matter there probably would be some sort of "safety" timer at the bonus server which would be started each time a token is sent. This safety time would be set to, for example, two or three times the expected bonus duration. If the token is not returned from the selected machine to the server in that amount of time, then the bonus server would create a new token. This would prevent the malfunction of a single game from freezing the process.

The timer 80 within the gaming machine can be set by any number of different methods, such as:

1. A fixed amount of time.
2. A fixed amount of time randomly determined within a range of possible times stored within the bonus server.
3. Time is increased or decreased based upon spin outcomes at the selected gaming machine so that, for instance, the more you win, the longer the bonus period.
4. The bonus session stays in effect until the first game win.
5. Time is determined based upon the "caliber" of the player as identified by the player tracking card. For example, VIP players which have proven their worth to the casino could get longer bonus periods.

In an alternate method, the length of the bonus period is determined based upon the number of spins and not the time. In this later case, timer 80 would be replaced or supplemented with a spin counter (not shown) adapted to count down from a pre-established or dynamically determined number of bonus period spins. It is understood that the invention is not limited to reel-based games such as slot machines. Accordingly, "bonus spin time" and "bonus period" spins are intended to be applied broadly to reel-based games such as slots as well as non-reel based games such as video poker.

In yet another embodiment, the bonus session can be outcome dependent meaning that the bonus session ends or continues based upon play at the base game. In a first example, the bonus period ends when the player has won a specified number of credits during the bonus session. Other criteria for ending the bonus session can be if the player has won a specified number of rounds during the bonus session or alternately a specified number of losing rounds or consecutive losing rounds. Finally, the bonus period can be ended if the base game yields some predetermined outcome, such as a particular combination of symbols on a reel-based slot game.

Reassign Bonus Token (Step 120)

Once the bonus period expires, the bonus token is passed back to the bonus server and then reassigned to a second selected machine. Several methods could be used to determine the next game to receive the bonus token. For example:

1. Simple Random—The next selected gaming machine could be selected at random from a list of all eligible gaming machines on the network, including the currently selected gaming machine. Every gaming machine in the list would have an equal probability of begin selected. This probability would be 1/N, where N is the total number of gaming machines on the link.
2. Random, no back-to-back—The next selected gaming machine could be selected at random from a list of all gaming machines on the link, except the previously (first randomly) selected gaming machine. The gaming machine so selected is referred to herein as the random second gaming machine. This would prevent "back-to-back bonuses" on the same machine. Every gaming machine eligible for selection would have an equal probability of being selected. The probability would be 1/(N−1)
3. Random without replacement—The next selected gaming machine would be selected from a list of gaming machines on the link. Once selected, the gaming machine would be removed from the list. The list would eventually decrement to zero once all eligible games on the link were selected. At that time all games would be added back to the list and the process would start over. Over the long term, the probability of being selected would be 1/N. Over a single "cycle", the probability of being selected would vary. Using this approach, it would be possible to guarantee that every machine would experience the bonus over the course of a certain time period.
4. Deterministic—The next selected gaming machine would be selected sequentially from a list of all gaming machines in which the sequence order is predetermined.
5. Weighted Random—The next selected gaming machine would be selected at random from a list of eligible gaming machines, however, machines would not have equal probability of being selected from the list. One possible embodiment of this method would be to assign a weighted number to each of the plurality of gaming machines on the link and selecting the machine ID within the bonus token based upon a weighted probability using the weighted number. This method can be used to equalize the payback percentage (bonus+base game) for different types of games on the network. This method would therefore allow games of widely differing base percentage amounts to be combined on a bonus token link. Games with high base payback, and therefore less available margin for bonuses, could still participate in the link. Such games would just enter the bonus mode less frequently than games with more available margin for bonuses.

An alternate application of the bonus token is to accrue a bonus pool from the gaming machines linked over the network. When the pool upper threshold is reached, the bonus token is passed to eligible machines according to the present invention for as long as the bonus pool is not depleted. Additionally, activation of the bonus tokens could be time-based so that they are active under specified times of the day and/or days of the week.

EXAMPLE

To understand the basic premise and to consider the effects on hold percentage, consider the following simple example of a bonus token game:

Configuration 100 participating games

All 100 games being played (simple case)

Games are 92% payback

Bonus Type

When the bonus token is passed to a machine, a bonus multiplier (MJT) is activated for the next 2 spins. Any pay table win on these two spins is multiplied by 2.

The approximate effect on payback percentage is determined as follows. Neglecting token transfer time, and time associated with the token being passed to a machine with a game in progress, each game will have the bonus token for 2 spins out of approximately 200 spins. The probability of being in the bonus mode is: 2/200 or 0.01. The contribution to the overall machine payback is:

$$0.01\times2\times92\%=1.8\%$$

The most important issue brought to light by the above example is what should happen if all games are not being played. If only 2 of the 100 machines are being played, then obviously the token cannot just pass back and forth continually between the two machines without severely affecting the payback percentage. If that happened, the bonus payback percentage in the above example would be:

$$0.5\times2\times92\%=92\%$$

This would give a total game payback of 184% which would mean that the casino would lose money on the machines. This is undesirable from the casino's perspective. There are several possible ways to get around this:

1. An inactive game holds the token—The bonus server passes the token. If the selected gaming machine is inactive it holds the token for a specified time period then passes the token back to the bonus server. The inactive game might display the fact that it has the token, but no bonuses could be paid. Someone must be playing a machine prior to receiving the token in order to enable the bonus feature.
2. The bonus server holds the token—The bonus server first passes the token. If the game is inactive it immediately returns the token and informs the bonus server that the gaming machine is inactive. The bonus server then holds the token until some pre-specified criteria were met. It then selects the next game and forwards the token. In the simple example above, when an inactive game is found, the bonus server can hold the token until two games are played on any one machine on the link. This would ensure that the bonus payback percentage remains constant.

Multiple Bonus Tokens

It would be possible to have multiple bonus tokens being passed around the same link. Token collisions (two or more tokens sent to the same machine at the same time) would have to be considered. Tokens could be identical—e.g. cause the same bonus feature to occur—or they could be unique (cause different types of bonuses to occur).

In one embodiment, token collisions could cause big bonuses to be paid. For example, if there were 3 unique tokens being passed around on a 100 game link, the probability of all three landing on a single machine at the same time would be 1/1,000,000. One could then afford to pay a bid bonus if this occurred.

Reception of each of the tokens at the gaming machines can be indicated via hat light 84 (FIG. 2). The hat light as shown in FIG. 2 includes three independently lighted sections which correspond to each of the three bonus tokens being passed around in the above embodiment.

Token Bingo

In another embodiment of the invention, bonus mode would be initiated only if either a certain number or type of bonus tokens are collected. Instead of immediately enabling a bonus mode on the machine, the occurrence of a bonus token could simply increment a bonus token counter in the player database. Tracking of bonus tokens received by a particular player would be maintained within accounting system 38 (FIG. 1) or other database coupled to the network. The player would insert his or her player tracking card 66 (FIG. 2) within the gaming machine when the token was passed to his machine. A signal would then be passed to the accounting system 38 indicating the token received and the player account that received it. A special bonus would be paid only after a player received a pre-specified number of bonus tokens. Or, in the case of multiple unique tokens, the player would have to "collect" all of the unique tokens in order to receive the prize—referred to herein as token bingo.

As an added twist, the award amount can be a function of how quickly the player is able to accumulate the requisite number of tokens. The less time used or games played to get all the tokens, the greater the player's award.

One could have unique tokens that were only available at certain times. For a player to win the bonus he or she would need to collect tokens from off-peak times as well as peak times. Alternately, certain tokens might only be available on certain machines. This has the advantage in that the casino could then encourage the player to try new games, or to play games of higher denomination or hold percentage.

Having described and illustrated the principles of the invention in a preferred embodiment thereof, it should be apparent that the invention can be modified in arrangement and detail without departing from such principles. We claim all modifications and variation coming within the spirit and scope of the following claims.

I claim:

1. A method for awarding bonuses over a gaming network having a plurality of gaming machines interconnected by a network, the method comprising the steps of:

allowing play to occur on a plurality of gaming machines;

setting an upper threshold;

accumulating a bonus pool responsive to play on the gaming machines;

selecting a first subset of the plurality of gaming machines when the accumulated bonus pool crosses the upper threshold;

sending a bonus token signal to at least one of the first selected subset of the plurality of gaming machines;

storing the bonus token signal at the at least one of the first selected subset of the plurality of gaming machines over the bonus period; and initiating a bonus period at only the at least one of the first selected subset of gaming machines responsive to the bonus token signal.

2. The method of claim 1, further including the step of paying out bonus awards from the bonus pool during the bonus period.

3. The method of claim 2, further including the steps of:

decrementing the bonus awards paid during the bonus period from the bonus pool to yield an adjusted bonus pool amount;

setting a lower threshold;

removing the bonus token signal from the first selected subset of gaming machines when the adjusted bonus pool amount crosses the lower threshold; and ending the bonus period contemporaneous with the step of removing the bonus token signal.

4. The method of claim 1, further including the steps of:

accumulating a temporary bonus pool during the bonus period responsive to play of the gaming machines during the bonus period; and transferring the temporary bonus pool into the bonus pool at the end of the bonus period.

5. The method of claim 4 wherein the step of accumulating the temporary bonus pool during the bonus period responsive to play of the gaming machines during the bonus period excludes those machines in the first subset of gaming machines.

6. The method of claim 1 wherein the first selected subset of machines is a number greater than one.

7. The method of claim 1, further including the steps of:

removing the bonus token signal from the first selected subset of gaming machines;

ending the bonus period contemporaneous with the step of removing the bonus token signal from the first selected subset of gaming machines;

selecting a second subset of gaming machines;

receiving the bonus token signal at the second subset of gaming machines; and initiating a bonus period at only at least one of the second selected subset of gaming machines responsive to the bonus token signal.

8. The method of claim 1, further including the step of reserving the bonus token at a bonus server coupled to the network until the first threshold is crossed.

9. A gaming machine network comprising:

a plurality of gaming machines, each of said machines having a machine control interface adapted to operate said gaming machine in either a normal operation mode or a bonus operation mode;

a bonus server linked to the plurality of gaming machines over a network, said bonus server including selection means for identifying at least a selected one of the plurality of gaming machines and signal generation means for generating a bonus token signal;

signal transmission means for sending the bonus token signal to the machine control interface of at least the selected one of the plurality of gaming machines responsive to the selection means, wherein the selected one of the plurality of gaming machines switches from the normal operation mode to the bonus operation mode responsive to the bonus token signal being received at the machine control interface; and storage means adapted to store the bonus token signal at the gaming machine during an entire period of operation in the bonus operation mode.

10. The gaming machine network of claim 9, further comprising:

a player server linked to the plurality of gaming machines, said player server including a database of player accounts;

player account identification means located at each of the plurality of gaming machines for identifying a player, associated with a respective player account stored within the player server, at the selected one of the plurality of gaming machines;

means for sending a flag signal to the player server responsive to the bonus token; and means for flagging the respective player account responsive to the flag signal.

* * * * *